United States Patent [19]

D'Antonio

[11] 4,416,387

[45] Nov. 22, 1983

[54] PAINT PRESERVER

[75] Inventor: Joseph V. D'Antonio, Media, Pa.

[73] Assignee: Richard L. Bates, Camillus, N.Y. ; a part interest

[21] Appl. No.: 387,448

[22] Filed: Jun. 11, 1982

[51] Int. Cl.[3] ..... B65D 25/10

[52] U.S. Cl. ..... 220/93

[58] Field of Search ..... 220/93

[56] References Cited

U.S. PATENT DOCUMENTS

| | | | |
|---|---|---|---|
| 1,978,025 | 10/1924 | McCown | 220/93 |
| 2,453,274 | 11/1948 | Serowy | 220/93 |
| 2,828,886 | 4/1958 | Thomas | 220/93 |
| 3,266,662 | 8/1966 | Craig | 220/93 |

*Primary Examiner*—George E. Lowrance

*Attorney, Agent, or Firm*—Squire, Sanders & Dempsey

[57] ABSTRACT

A device for preserving paint and other substances in a container comprising a circular central portion having an upwardly extending, elongated resilient handle, a pair of peripheral channels on opposite sides of said handle, ribs extending radially outwardly opposite the ends of the handle to define the ends of the channels and a sealing flange extending radially outwardly from the outer wall of the channel. The device folds along the ribs upon compression of the handle so that the device can be inserted into and removed from the container.

7 Claims, 4 Drawing Figures

PAINT PRESERVER

BACKGROUND OF THE INVENTION

The invention relates to the preservation of substances in a container, and in particular to the preservation of the liquidity of paint, varnish, lacquer, shellac and the like in cylindrical containers.

Paint, varnish, shellac and a great many other liquids are conventionally packaged in containers having bases and upstanding walls, these containers commonly being in the form of cylindrical metal cans. The containers are provided with covers or lids for preventing spillage, contamination of the liquid, and in the case of liquids of the type to which this invention has particular applicability, for preventing the drying of the liquid to form a skin thereon. (In the discussion to follow, reference shall be made to the preservation of the liquidity of paint, but the reference to paint should be understood to extend to any liquid having a tendency to dry to an extent to form a hardened surface or skin on the liquid, as well as to particulate solids such as coffee which deteriorate when exposed to ambient air). The paint containers are usually provided with a rim configured to engage the correspondingly configured lip of the lid to seal—preferably hermetically—to prevent the flow of air across the paint and the concomitant drying of the surface of the paint due to the evaporation of moisture therefrom. It is well known, however, that even though a fresh can of paint generally preserves the liquidity thereof, once opened the seal of the lid on the can cannot be re-established to prevent the drying of the paint. Moreover, it is not an infrequent occurence that the lid of a partially used can of paint is either mislaid or so badly bent that it cannot be reaffixed to the container, in which case the entire unused portion of the paint is likely to become dried out and unusable.

Prior proposals for preserving paint have not been adopted, and those proposals are either impracticable or uneconomical. Various patents have issued disclosing devices having components for engaging the surface of paint or the like in a container to prevent the drying of the liquid, and in some instances peripheral skirts engaging the inner surface of the containers block the passage of air to the surface of the liquid. Such patents include U.S. Pat. Nos. 1,092,902, 2,453,274, 2,465,755, 2,566,195, 2,609,119, 2,616,590, 3,049,261, 3,129,842, 3,266,662, and 3,784,051. The devices described in the preceding patents all have a plurality of components, and none of them have means for evacuating air once the device is seated on the liquid to be preserved. U.S. Pat. Nos. 1,936,857 and 3,578,478 disclose complex devices for preserving coffee; the former of these patents includes a bulb for evacuating air from the coffee, but this is not done to enhance the sealing effect of the device on the coffee. U.S. Pat. No. 890,196 describes a tobacco package having a sponge held in place over the tobacco by a spring biassed cup to keep the tobacco moist. A lid for hermetically sealing a container such as an ice cube tray is the subject of U.S. Pat. No. 3,164,289. The foregoing patents thus relate to complicated devices for preserving various liquids or solids, and they have not found acceptance in the marketplace.

The invention in its preferred form is a unitary device including a circular central portion having an upstanding, resilient, compressible handle, a downwardly extending channel extending around the central portion, radially ribs extending across the channel, and a peripheral flange for engaging the walls of the container. The cover folds along the ribs upon compression of the handle to enable the insertion and removal of the device into and out of a container.

DESCRIPTION OF THE PREFERRED EMBODIMENT

Figure 1:
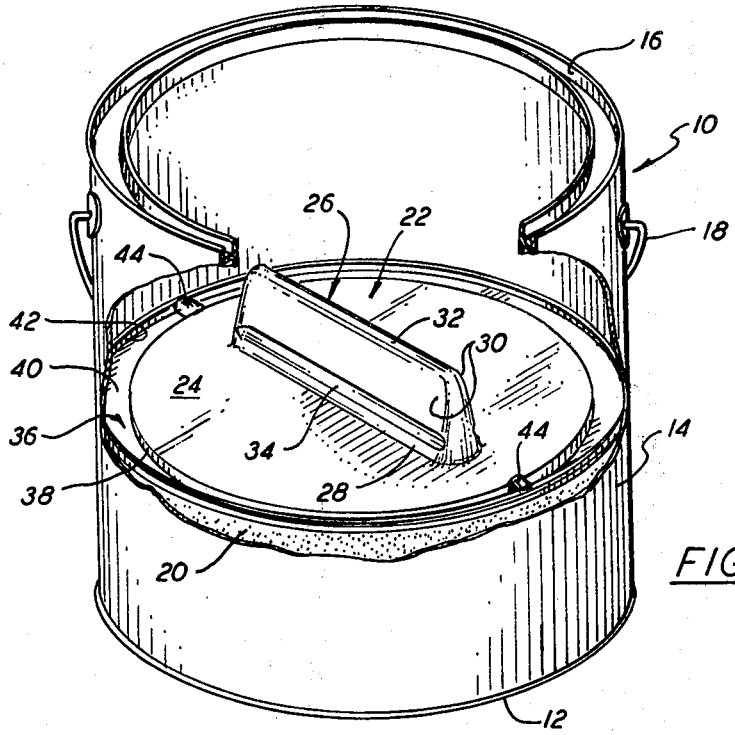
FIG. 1 is a perspective view of an uncovered, conventional can of paint, with a portion cut away to reveal a device according to the invention.
Figure 2:
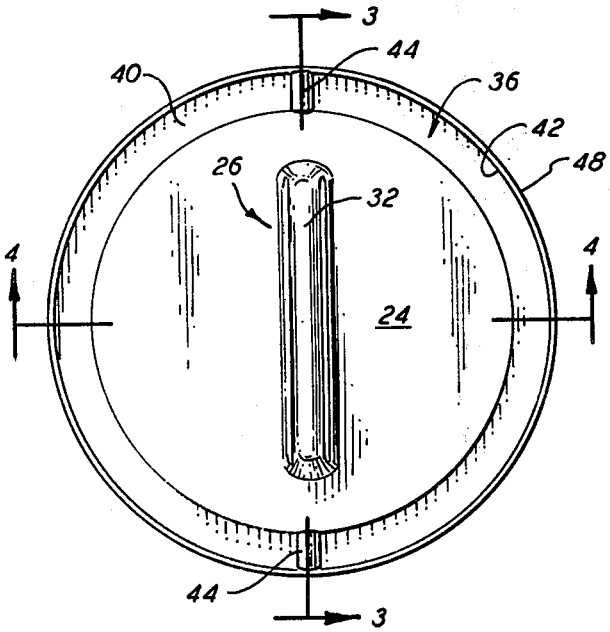
FIG. 2 is a top plan view of the device according to the invention as shown in FIG. 1.

Referring to the drawings, a conventional paint container in the form of a can 10 is shown. Can 10 includes a base 12 from which extends an upstanding cylindrical wall 14 which terminates in a rim 16 configured to receive the lip of a cover or lid (not shown). A handle 18 is provided for carrying can 10. A quanitity of paint 20 is disposed in can 10. A device 22 according to the invention is shown resting on the surface of paint 20. Device 22 includes a central portion 24 which is circular in shape, and from which extends in an upward direction a handle 26. Handle 26 extends crosswise of central portion 24, and has opposite long sides 28 which taper upwardly from a generally wide base 30 to a relatively narrow apex 32. A pair of parallel, opposed grooves 34 extent substantially along the lengths sides 30. Handle 26 is fabricated from a flexible, resilient material which is collapsible under finger pressure to sides 30 and which assumes its uncollapsed shape upon removal of such pressure.

Figures 3, 4:
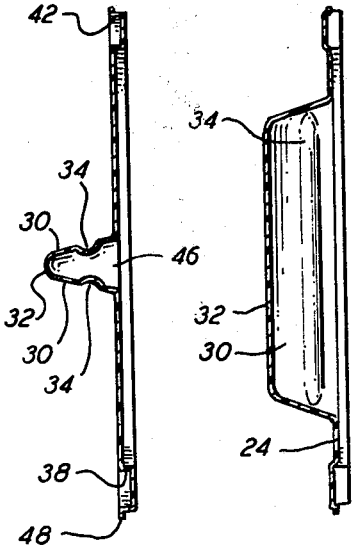
FIG. 3 is a sectional view of the device of FIG. 2 taken in the direction of arrows 3—3.
FIG. 4 is a sectional view of the device shown in FIG. 2 taken in the direction of the arrows 4—4.

A circular channel 36 extends around central portion 24, and is defined by an inner wall 38 extending downwardly from the periphery of portion 24, a base portion 40, and circular outer wall 42 extending upwardly from base portion 40. A pair of ribs 44 extend across channel 36 opposite the ends of handle 26 which divide channel 36 into a pair of opposite annular channels and which serve as crease means defining a crease along which device 26 folds upon the application of collapsing pressure to handle 26. As shown most clearly in FIG. 4, a cavity 46 is formed in the lower side of device 22 defined by the underside of central portion 22, the inside of handle 26, and the underside of inner wall 38. A peripheral flange 48 extends outwardly from the upper edge of outer wall 42. Preferably, the diameter of flange 46 slightly exceeds the inner diameter of can 10 so that the flange engages the interior surface of wall 14 to block the passage of air to the paint.

Device 22 is impervious to air. Member 22 is preferably a unitary which is flexible and resilient, and impervious to paint (or whatever substance is to be protected). A particularly suitable material is dense polyvinyl chloride, which is in the form of sheet material. A thickness of about 0.0001" has been found satisfactory for cans of about $5\frac{3}{4}$" in diameter.

In use, the paint preserving device is folded along the line defined by ribs 44 upon the application of finger pressure to handle sides 30. Grooves 34 assist in the collapsing of handle 26. The folded device is inserted through the opened end of a can of paint, the finger pressure is released allowing the device to unfold, and it is seated on the surface of the paint with handle 26 facing upward away from the paint. The underside of bottom wall 40 contacts the surface of the paint, and flange 48 seals the outer surface of the paint against the ambient air. The sealing effect is enhanced by a band of paint which flows between the edge of flange 48 and the inner surface of the can. Such paint flow occurs as a result of the pressure applied to the device against the paint when the device is inserted into the can forcing the paint upwardly on the sidewall, and because of capillary action. This is important since paint cans are normally not perfectly circular, and the engagement of flange 48 with the paint can wall is not continuous. The paint not only fills any gaps between the flange and the wall, but further forms an adhesive bond when it dries to hold the device in place. Once the device is inserted in the can and released, a partial vacuum is formed in cavity 46. The partial vacuum in cavity 46 causes ambient air pressure to bear against device 22 to enhance the contact of the device against the paint and against the inner wall of container 10. When device 10 is so seated, the evaporation of moisture from the paint is significantly prevented, and the paint is preserved. To remove device 10, one simply squeezes sides 30 of handle 26 to fold the device and break the seal and vacuum, and pulls the device from the can.

Devices according to the invention can be made at very low costs using conventional manufacturing methods. The device shown in the drawings is preferably made by thermoforming the product from sheet stock on a reverse mold of the finished product from a sheet of thin, dense polyvinyl chloride or the like, and stamping the part from the sheet with a die.

The invention has been described in detail with particular reference made to the preferred embodiment, but it is to be understood that variations and modifications within the spirit and scope of the invention may occur to those skilled in the art to which the invention pertains.

I claim:

1. A device for protecting a substance in a container having a cylindrical wall with an inner diameter and a closed bottom, against the environment, said device having an upper side and a lower side and comprising:

a generally flat, resilient central portion;

a compressible, elongated, resilient hollow handle extending upwardly from and in a crosswise directions to said central portion, said handle having opposite end sections and side sections;

channel means extending peripherally about said central portion, said channel means including a base portion, an inner wall portion extending upwardly from said base portion and a generally circular outer wall portion extending upwardly from said base portion, said central portion extending across the upper part of said inner portion to form a cavity when said device is sitting on the substance in the container for rendering said device buoyant;

crease means extending radially across said channel means; and an annular peripheral portion extending radially outwardly from the outer wall portion of said channel means for engaging the wall of a container in which said device is inserted;

said device having a generally flattened open condition and folding along said crease means upon the compression of the side sections of said handle into a closed position for reducing the projected area of said device for enabling the insertion and removal of said device into and out of a container, said device assuming the open position upon release of said handle in a container for covering the substance and sealing the substance from the environment.

2. A device according to claim 1 and further including indentations along the side sections of said handle for facilitating the folding of said device upon the compression of said handle.

3. A device according to claim 1 wherein said peripheral portion is a flattened flange.

4. A device according to claim 1 wherein said device is a unitary article.

5. The invention according to claims 1 or 4 wherein said device is made of high density polyvinyl chloride.

6. A device according to claim 1 wherein said central portion is circular and concentric with said channel means and said annular peripheral portion.

7. The invention according to claim 1 wherein said crease means comprise ribs extending radially outwardly across said channel means opposite the ends of said handle.

* * * * *